United States Patent [19]

Sasaoka et al.

[11] Patent Number: 4,532,421

[45] Date of Patent: Jul. 30, 1985

[54] APPARATUS FOR COUNTING PAPER SHEETS

[75] Inventors: Takashi Sasaoka; Tsuneyoshi Mitani, both of Kawasaki, Japan

[73] Assignees: Musashi Co., Ltd.; Musashi Engineering Kabushiki Kaisha, both of Tokyo, Japan

[21] Appl. No.: 504,480

[22] Filed: Jun. 15, 1983

[30] Foreign Application Priority Data

Jul. 10, 1982 [JP] Japan ..... 57-120154

[51] Int. Cl.[3] ..... G06M 7/00

[52] U.S. Cl. ..... 250/223 R; 377/8

[58] Field of Search ..... 250/222.2, 223 R; 377/53, 8

[56] References Cited

U.S. PATENT DOCUMENTS 4,128,756 12/1978 Nagano et al. ..... 377/8
4,352,980 10/1982 Hibari ..... 377/53
4,381,447 4/1983 Horvath et al. ..... 250/223 R

*Primary Examiner*—David C. Nelms
*Assistant Examiner*—J. Jon Brophy
*Attorney, Agent, or Firm*—Brooks, Haidt, Haffner & Delahunty

[57] ABSTRACT

Described is a counting apparatus for counting paper sheets settable when effecting a batch counting to a clear mode in which the count data obtained in the counting operation of each preceding batch of paper sheets are cleared for counting a new batch or to an add mode in which the count data for the current batch is added to the count data for the preceding batch or batches and the resulting sum of the count obtained until the current time is displayed.

1 Claim, 1 Drawing Figure

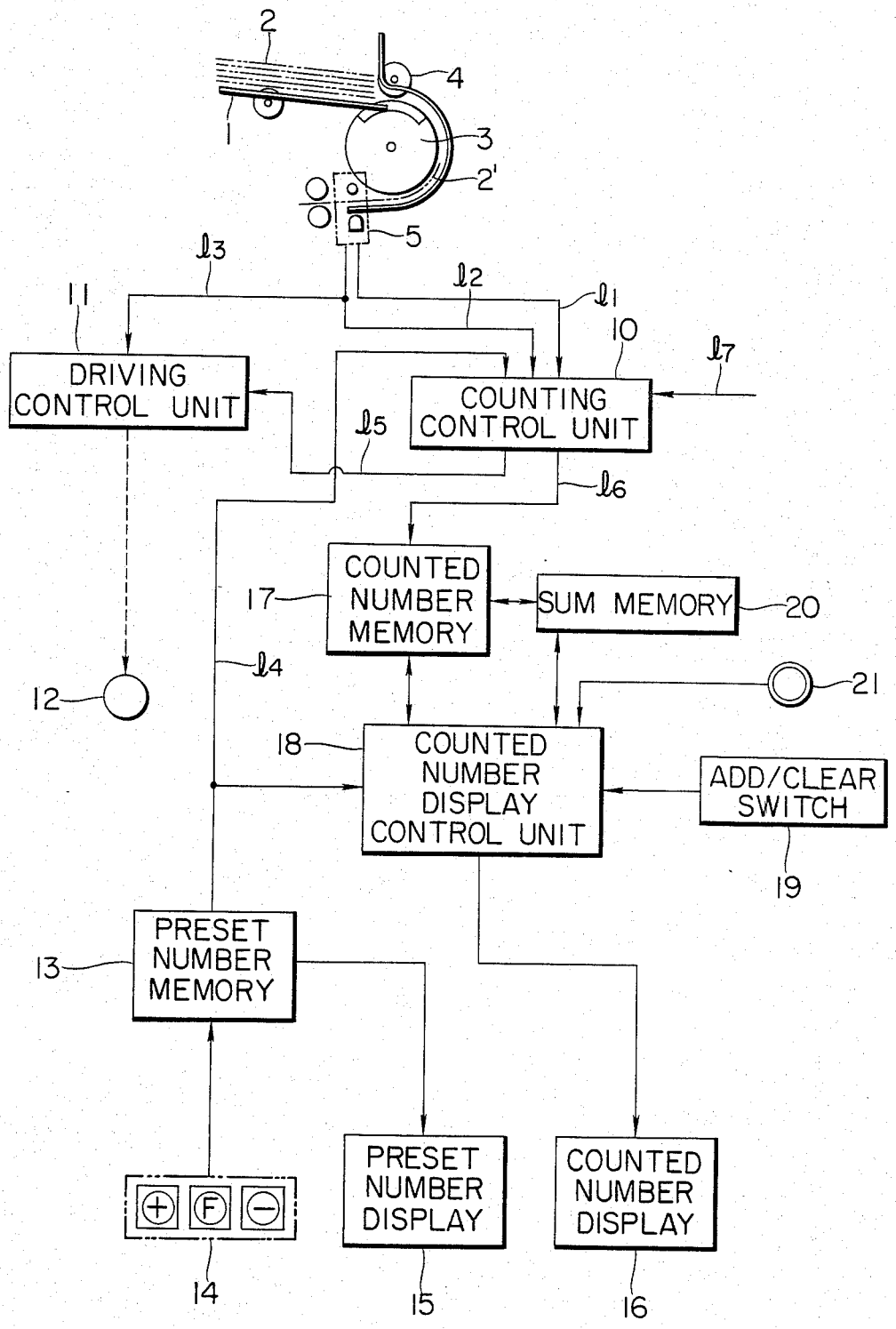
2
4
1
3
2'
5
ℓ3
ℓ2
ℓ1
11
10
ℓ7
DRIVING CONTROL UNIT
COUNTING CONTROL UNIT
ℓ5
ℓ6
COUNTED NUMBER MEMORY
17
SUM MEMORY
20
ℓ4
12
21
18
COUNTED NUMBER DISPLAY CONTROL UNIT
ADD/CLEAR SWITCH
19
PRESET NUMBER MEMORY
13
PRESET NUMBER DISPLAY
COUNTED NUMBER DISPLAY
14
15
16

APPARATUS FOR COUNTING PAPER SHEETS

BACKGROUND OF THE INVENTION

This invention relates to an apparatus for counting of paper sheets.

Among the apparatus of this kind are those employed for counting bank notes, voting papers, cards, checks or bills. In these apparatus, different counting methods are used according to the object of counting. For instance, when it is desired to know the total number of the paper sheets under examination or check the number of the paper sheets which should have a certain nominal number, the paper sheets are counted without interruptions (continuous counting). On the other hand, when it is desired to prepare bundles or batches each containing a predetermined number of paper sheets, a batch counting is employed.

SUMMARY OF THE INVENTION

The present invention resides in a counting apparatus for counting paper sheets settable when effecting the batch counting to a clear mode in which the count data obtained in the counting operation of the preceding batch of paper sheets are cleared for counting a new batch, or to an add mode in which the count data for the current batch is added to the count data for the preceding batch or batches and the resulting sum of the count obtained until the current time is displayed.

BRIEF DESCRIPTION OF THE DRAWING

This invention will become more readily apparent from the following description of a preferred embodiment thereof shown, by way of example only, in the accompanying drawing, in which the sole figure is a block circuit diagram showing a paper sheet counting apparatus according to an embodiment of the present invention.

DESCRIPTION OF THE PREFERRED EMBODIMENT

Reference is made to the accompanying drawing for illustrating an embodiment of the present invention. In the drawing, paper sheets 2 are placed in a stack on a paper sheet supply station 1, from which the sheets are transferred in the form of an individually separated paper sheet 2' by a feed roll 3 and a separating drum 4. A sensor 5 is placed in the path of transport of the sheets for sensing the number and state of the paper sheets 2' as well as the state of transport. The sensor 5 may be of any known type and consist e.g. of one or more pairs of light emitting and receiving elements placed opposite to each other.

The sensor 5 issues a counting signal to a counting control unit 10 through a line $l_1$ whenever a sheet 2' travels past the sensor. When the sheets are under an unusual transport state while travelling past the sensor 5, as when two or more sheets are stacked partially or completely or fed with small distances apart from each other, the sheets are folded upon themselves or when the paper sheet size is above or below the nominal size, such state is sensed by the sensor 5 which then issues a signal indicating such unusual transport state to the counting control unit 10 through a line $l_2$ and simultaneously to a driving control unit 11 through a line $l_3$ for halting a driving electric motor 12 and terminating the transport of paper sheets 2.

A preset number memory 13 stores a preset number which it has received from a preset number setting button unit 14 and outputs the thus stored preset signal to the counting control unit 10 through a line $l_4$, while indicating the number thus set by the preset signal or a preset number display unit 15 (LED).

The preset number setting button unit 14 is designed for setting a designated number of the paper sheets and comprised of an F-button, a plus button and a minus button. Upon pressing the F-button, a predetermined number of numerical figures is cyclically introduced into the preset number memory 13 and cyclically displayed on the preset number display unit 15. When the desired numerical figure is displayed, the pressure on the F-button is released, the figure being thus stored in the memory 13 and displayed on the preset number display unit 15. If then the plus button is pressed, the figure stored in the memory 13 and displayed on the display unit 15 is sequentially incremented by one and the figure thus incremented is stored and displayed cyclically. When the desired figure is reached, it is stored and displayed by finally releasing the pressure on the plus button. When the minus button is pressed, the figure currently stored and displayed is decremented by one each time the minus button is pressed and the figure thus decremented is stored and displayed cyclically. The range of such adjustment through the plus and minus buttons may be limited respectively to one hundred, if so desired.

The counting control unit 10 receives the counting signal and the unusual transport signal from the sensor 5 and the setting signal from the preset number memory 13. When the device is in the batch counting operation, the counting signal from line $l_1$ and the setting signal from line $l_4$ are compared to each other in the unit 10. Whenever these signals are coincident with each other, a signal is supplied from the unit 10 to the driving control unit 11 through line $l_5$ for halting the driving motor 12.

A signal indicating the counted number is supplied a counted number display 16 unit (LED) from the sensor 5 through the control unit 10 and the line $l_6$ for display at the display unit 16. According to the present invention, during batch operation, this display is made in two aspects, namely in the clear mode batch counting and in the add mode batch counting aspects. To this end, there are provided, between the counting control unit 10 and the counted number display unit 16, a counted number memory 17, a counted number display control unit 18, and add/clear switch 19 connected to this control unit 18, a provisional sum memory 20 and a reset switch 21.

The operation for the clear mode batch counting and the add mode batch counting will be described below in more detail.

For clear mode batch counting, the add/clear switch 19 is set to clear, and the counted number display control unit 18 is set to the clear mode. The counting operation is now started and the counting signal is supplied from the sensor 5 through the counting control unit 10 to the counted number memory 17 where it is received and stored. The counting signal is transmitted from the memory 17 to the counted number display control unit 18 which then causes the counted numbers to be displayed sequentially in the counted number display unit 16.

When an unusual transport state of the paper sheets has occurred prior to the count number reaching the preset batch number, such state is sensed by the sensor 5, which then transmits an unusual transport signal to the driving control unit 11 and the counting control unit 10.

When the unusual transport signal is received by the driving control unit 11 through line $l_3$, the operation of the driving motor 12 ceases. When the same signal is received by the counting control unit 10 through line $l_2$, the count number that prevailed directly before the occurrence of the unusual state is stored in the count number memory 17, while the memory updating is brought to a stop. The counted number display control unit 18 operates to cause the counted number stored in the counted number memory 17 to be displayed in the counted number display unit 16.

The reset switch 21 is then actuated to clear the data stored in the counted number memory 17, the counted number display unit 16 being then reset to zero by the operation of the counted number display control unit 18.

When the counting operation is started again in this state, the count number again starts to be introduced and stored sequentially in the counted number memory 17. The count number thus stored in the memory 17 is displayed in the counted number display unit 16 by the operation of the counted number display control unit 18.

When the paper sheets 2 have become depleted in the paper sheet supply station 1 in the clear mode batch counting, the counting control unit 10 senses that no paper sheets are passing through the sensor 5, so that the counting operation is stopped automatically. In such case, the counting operation is restarted when the paper sheets are supplied again to the supply station, and is continued until the count number is equal to the preset number.

Assuming that, when the paper sheets 2 have become depleted in the paper sheet supply station 1 and thus the counting operation is terminated automatically, the paper sheets stored in a receiving container, not shown, are taken out therefrom in their entirety, such state is sensed by the counting control unit 10 through a line $l_7$ connected to said receiving container. When a new batch of paper sheets 2 is then placed in the supply station 1, the control unit 10 operates to reset the counted number memory 17 and the counted number display unit 16 to zero, while simultaneously restarting the counting operation and storage as well as display of the count number for a new batch of paper sheets.

When it is desired to effect the add mode batch counting, the add/clear switch 19 is switched to add, thereby setting the counted number display control unit 18 to the add mode. In the following description, it is presupposed that batch counting is performed using the preset number 100.

Whenever the counted number has exceeded 100, the data stored in the counted number memory 17 is transferred to the provisional sum memory 20 for accumulative storage and the sum of the previously obtained provisional sum and the current count number is displayed in the count number display unit 16 by the operation of the count number display control unit 18. For instance, when the count has reached 243, the figure 200 is stored in the provisional sum memory and the figure 43 is stored in the counted number memory 17. The data stored in the provisional sum memory or the figure 200 and the data stored in the counted number memory 17 or the figure 43 are read out from these memories and totalled by the operation of the count number control unit 18 and the resulting sum is displayed in the count number display unit 16.

In the event of the occurrence of an unusual transport state, it is sensed by the sensor 5 which then delivers an unusual transport signal. This signal is received by the drive control unit 11 and the counting control unit 10. Thus the unit 11 operates to halt the driving motor 12 while the unit 10 operates to terminate the counting operation. The reset button is activated at this time, whereby the FIG. 43 stored in the counted number memory 17 is cancelled, while the counted number display control unit 18 reads out the figure 200 stored in the provisional sum memory for display of the figure 200 in the counted number display unit 16.

When the counting is started again, the new count is stored in the counted number memory 17 and added to the uncancelled figure 200 stored in the provisional sum memory 20 and the resulting sum is displayed in the counted number display unit 16.

When the reset switch 21 is pressed once in the event of detection of the unusual transport state and resulting cessation of the counting operation, only the figure stored in the counted number memory 17 is cancelled, as mentioned hereinabove. When the reset switch is pressed a second time, the figure stored in the provisional sum memory 20 is also cancelled and the counted number display unit 16 is reset to zero.

As will be apparent from the foregoing description of the present invention, when the add/clear switch 19 is set to the clear mode, the number of paper sheets can be counted up to the preset number and, upon the occurrence of the unusual transport state, the reset switch 21 can be pressed for erasing the data of the counted number for recounting the number in the batch of the paper sheets. When the add/clear switch is set to the add mode, the reset switch 21 can be pressed once for erasing only the data of the counted number concerning the current batch of paper sheets and without erasing the data of the sum of the paper sheets up to the preceding batch. In this manner, the laborious operation of recounting the total number of paper sheets for each occurrence of the unusual transport state may be eliminated. In addition, the data of the total number of the paper sheets can be erased by pressing the reset switch 21 twice.

It should be noted that the counting device for the paper sheets can be reduced in size through the use of a microprocessor in the circuit shown in the drawing.

What is claimed is:

1. A counting device for paper sheets comprising:

a sensor provided in a paper sheet transfer path adapted for transporting the paper sheets from a paper sheet supply station to a paper sheet receiving station, said paper sheets being separated during transport through said path into individual paper sheets from a stack held in the supply station, said sensor sensing the number of the paper sheets passing therethrough and issuing a count number signal, said sensor also sensing the occurrence of an unusual transport state and issuing an unusual transport signal upon occurrence thereof;

a counting control unit adapted for comparing said count number signal from said sensor to a preset number signal from a preset number memory and issuing a corresponding control signal;

a drive control unit for controlling the driving of said transport path depending upon said control signal supplied from said counting control unit and for terminating the driving of said transport path upon reception of said unusual transport signal from said sensor;

a counted number memory for receiving and storing said count number signal supplied from said sensor through said counting control unit;

a counted number display control unit for receiving said counted number signal stored in said counted number memory and displaying a numerical figure corresponding to said counted number signal in a counted number display unit;

an add/clear switch connected to said counted number display control unit and adapted for setting the counting and display mode to an add mode batch counting or to a clear mode batch counting;

a provisional sum memory for storing the sum obtained until the end of counting of the preceding batch of paper sheets and outputting the stored data to said counted number display control unit;

a reset switch for resetting said counted number memory and said provisional sum memory; and said counted number display control unit operating during batch counting in such a manner that the sum obtained until the end of counting of the preceding batch is not displayed in said counted number display unit when the add/clear switch is set to clear mode batch counting, the data stored in said provisional sum memory and the data stored in said counted number memory are added together and the resulting sum is displayed in said counted number display unit when said add/clear switch is set to the add mode batch counting and that only the data stored in said counted number memory is erased when said reset switch is pressed once while both the data stored in said counted number memory and the data stored in said provisional sum memory are erased when said reset switch is pressed twice.

* * * * *